US009228372B2

(12) United States Patent
Bertato

(10) Patent No.: US 9,228,372 B2
(45) Date of Patent: Jan. 5, 2016

(54) FENCE RAIL AND BRACKET SYSTEM

(71) Applicant: Maurizio C. Bertato, Uxbridge (CA)

(72) Inventor: Maurizio C. Bertato, Uxbridge (CA)

( * ) Notice: Subject to any disclaimer, the term of this patent is extended or adjusted under 35 U.S.C. 154(b) by 0 days.

(21) Appl. No.: 13/999,441

(22) Filed: Feb. 26, 2014

(65) Prior Publication Data

US 2015/0240516 A1 Aug. 27, 2015

(51) Int. Cl.

| | |
|---|---|
| ***E04H 17/00*** | (2006.01) |
| ***E04H 17/14*** | (2006.01) |
| *E04F 11/18* | (2006.01) |

(52) U.S. Cl.

CPC ..... *E04H 17/1421* (2013.01); *E04F 11/181* (2013.01); *E04H 2017/1447* (2013.01)

(58) Field of Classification Search

CPC ..... E04F 11/181; E04H 17/1421; E04H 2017/1447

USPC ..... 256/22, 59, 65.01, 65.02, 65.03, 65.06, 256/65.08

See application file for complete search history.

(56) References Cited

U.S. PATENT DOCUMENTS

| | | | | | |
|---|---|---|---|---|---|
| 2,771,276 | A * | 11/1956 | Constance, Jr. et al. | ..... | 256/22 |
| 3,756,567 | A * | 9/1973 | Murdock | ..... | E04F 11/181 256/21 |
| 4,623,128 | A * | 11/1986 | Dutch et al. | ..... | 256/65.08 |
| 5,788,224 | A * | 8/1998 | Platt | ..... | 256/66 |
| 6,149,206 | A * | 11/2000 | DiRocco | ..... | 285/305 |
| 6,431,612 | B1 * | 8/2002 | Walker et al. | ..... | 285/305 |
| 6,893,008 | B2 * | 5/2005 | Forbis | ..... | 256/65.05 |
| 7,014,220 | B2 * | 3/2006 | Szabo et al. | ..... | 285/305 |
| 7,168,688 | B2 * | 1/2007 | Davenport | ..... | 256/24 |
| 7,216,855 | B2 * | 5/2007 | Platt | ..... | 256/65.03 |
| 7,992,841 | B2 * | 8/2011 | Petta et al. | ..... | 256/65.07 |
| 2006/0091372 | A1 * | 5/2006 | Rosian | ..... | 256/65.01 |
| 2008/0279621 | A1 * | 11/2008 | Chaupin | ..... | 403/345 |
| 2011/0073824 | A1 * | 3/2011 | Lappin et al. | ..... | 256/65.08 |

* cited by examiner

*Primary Examiner* — Daniel P Stodola
*Assistant Examiner* — Nahid Amiri

(57) ABSTRACT

A fence system having upright posts and transverse fence rails, formed of hollow rectangular tubular construction and having internal ribs formed within the hollow interior; a plurality of angular mounting brackets defining a transverse insertion portion and an upright attachment portion, and wherein the transverse insertion portions are adapted to make a frictional fit within the interior of said hollow tubular rails, and a plurality of fastening holes in said attachment portions, whereby the same may be secured to a fence post.

6 Claims, 8 Drawing Sheets

FENCE RAIL AND BRACKET SYSTEM

FIELD OF THE INVENTION

The invention relates to fence systems and in particular to fence systems incorporating elongated hollow rail members, and to attachment brackets for attaching the rail members to upright posts.

BACKGROUND OF THE INVENTION

Rail systems for enclosing property are known to incorporate a wide variety of designs. A particularly advantageous rail system is based on transverse elongated hollow metal rails. In particular the hollow rails preferably comprise rectangular tubes. It is desirable to provide means for attaching the ends of the rails to upright posts. In addition it is desirable to provide means for supporting balusters between upper and lower rails, at spaced intervals between the posts.

Such rail systems may provide an ornamental system but usually will be required to provide some form of physical restraint. Forces are usually lateral forces, and also vertical forces and it is desirable to ensure that such rails are of adequate strength to resist such forces.

In addition to these factors it is desirable, from the view point of aesthetics and appearance that the metallic hollow tubular rails shall abut securely up against the sides of the posts. It will be borne in mind that all of these systems must be adaptable to a wide variety of different types of property and to variations in terrain, and they must be adapted for installation by service personnel in a systematic and repeatable fashion.

BRIEF SUMMARY OF THE INVENTION

With a view to providing a fence system meeting these various objectives, the invention comprises a fence system having transverse fence rails, formed of hollow rectangular tubular construction and having internal reinforcing flanges formed within the hollow interior lengthwise, a plurality of angular mounting brackets defining a transverse insertion portion and an upright attachment portion, and wherein the transverse insertion portions are adapted to make a sliding frictional fit within the interior of said hollow tubular rails, and wherein said attachment portions define a plurality of fastening holes, for the insertion of balusters, or to secure a connector to hold such balusters, whereby the same may be secured to a fence post.

Usefully, the invention will provide such internal flanges extending lengthwise along the interior of said rails, and wherein said insertion portions of said brackets are dimensioned to make a secure frictional fit with said flanges, and further incorporating at least one fastening member adapted to be inserted from the underside of said rail, engaging said insertion portion of said bracket.

Usefully the invention will further provide that the insertion portion of the bracket will define angular edge flanges along each edge.

Usefully the invention further provides that the insertion portion and the attachment portion of the bracket meet one another at an angled bend, and including rectangular recesses formed in said bracket at the bend at opposite ends thereof.

The invention further provides an end trim clip having a horizontal transverse cross portion and upright side portions, formed of synthetic material, and adapted to be snap fitted around said rail, adjacent its junction with a said fence post.

The invention further provides a plurality of baluster holes in the hollow rails to secure a connector to hold such balusters and a plurality of upright intermediate balusters secured in said hollow rail at their upper ends, and making a friction fit with the interior flanges.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
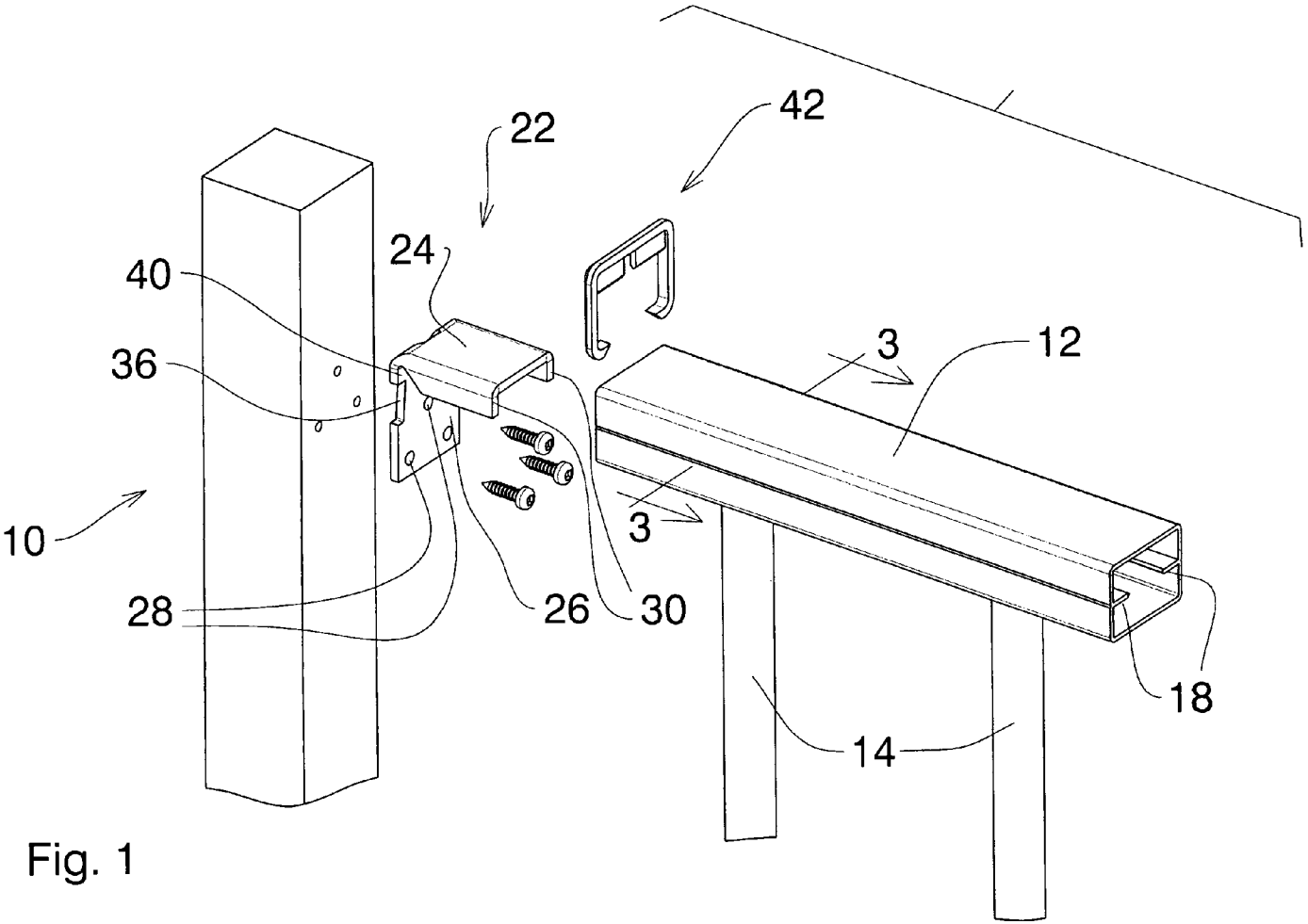
FIG. 1 is an exploded perspective illustration of a fence illustrating the fence system according to the invention.

Referring first of all to FIG. 1, it will be seen that the invention is there illustrated in the form of a fence system.

This illustration shows a fence which comprises upright posts (10) normally being firmly secured in the ground at spaced intervals, or firmly secured to a base such as concrete or stone in well known manner. The posts may be wood, metal or other materials adequate to support the loads on the fence.

The fence further incorporates transverse upper and lower hollow rails (12) , extending in between adjacent posts (10). In order to complete the fence, uprights balusters (14) are supported within the interior of the transverse rails (12). Such balusters may be supported at the bottom in a lower region on some other form of support including an alternate rail and/or alternate means to secure the baluster, like a surface mounted baluster connector, extending between the posts (not shown). which may be similar hollow rails, or some other rail systems.

Figure 3:
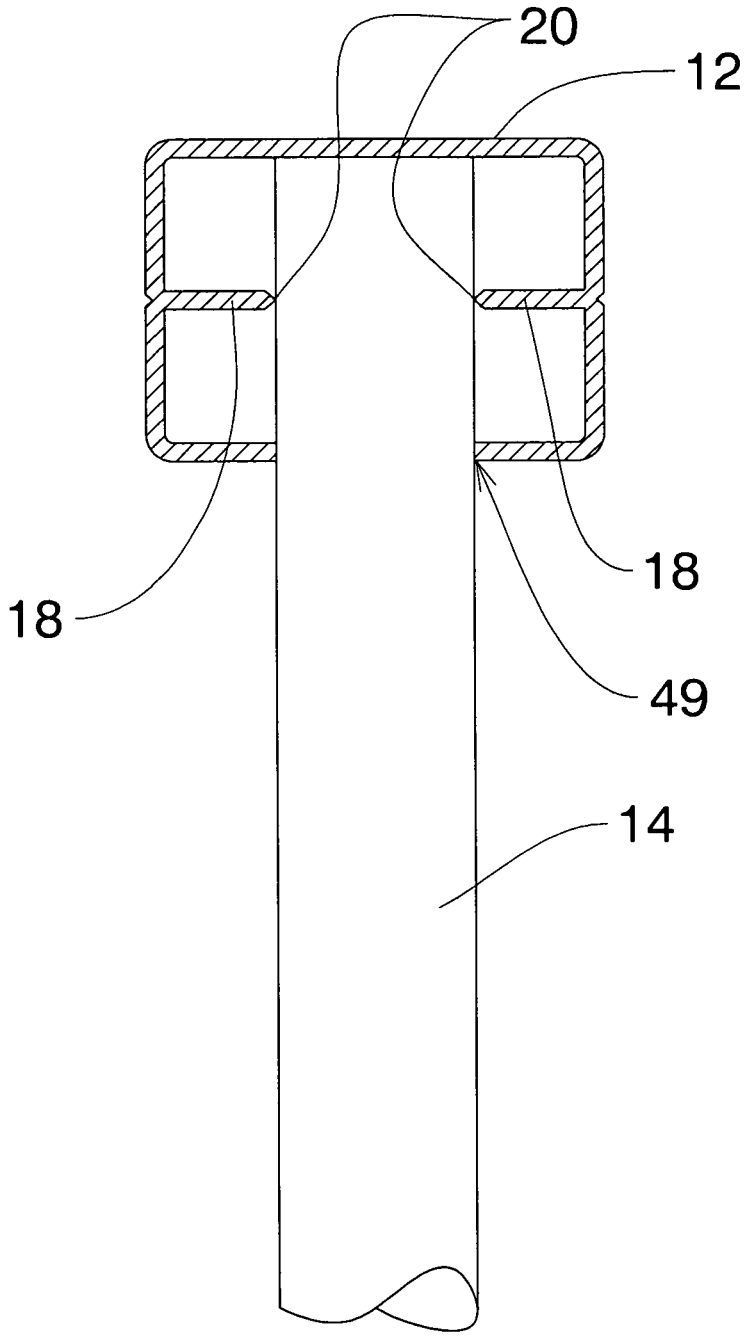
FIG. 3 is a section along the line 3-3 of FIG. 1.

For reason described below, the hollow rails are formed on the inside with interior reinforcing bracing flanges (18) on opposite sides of said rail, lying in a common plane. A secondary reason for the internal flanges is to make the rail more resistant to lateral forces, as the flanges add mass in a location that increase the $4^{th}$ moment of inertia significantly. This design makes this unique to other square or rectangular designs commonly on the market. Flanges (18) terminate on their inwardly directed ends in generally V-shaped sharp edges (20) (FIG. 3) and define a spacing there between for reception of said balusters.

In order to support the ends of the rails (12) on the posts (10), angular attachment brackets generally indicated as (22) are provided. The angular attachment brackets (22) defining a transverse rail insertion portion (24), and an upright post attachment portion (26).

The upright attachment portions (26) are provided with, in this case, a plurality of fastening holes (28), by means of which they may be screwed, for example, to a wooden post.

Figure 4:
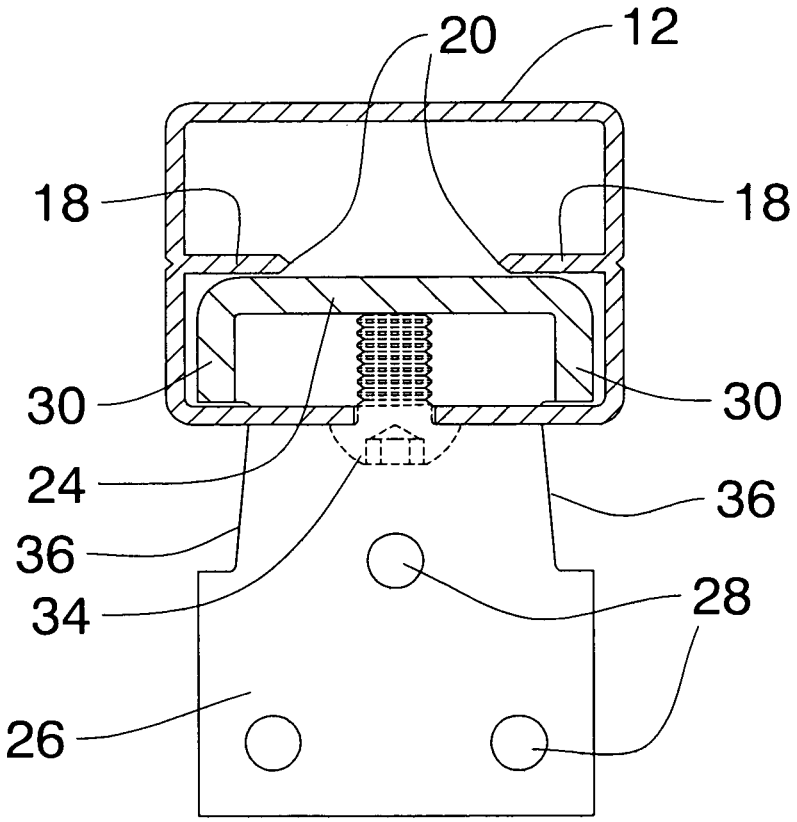
FIG. 4 is a section along the line 4-4 of FIG. 2.

The transverse rail insertion portions (24) are formed with a generally shallow U-shaped section, defining edge ribs (30) and an intermediate planar portion, with the edge flanges normal to the planar portion. For purposes of security, the edge ribs (30) and planar portion are intended to make a snug frictional fit within the hollow rail (12) (FIG. 4). More importantly the flanges (18) provide a stop for the brackets to be located. Thus the planar portion is substantially the width of the hollow interior of the rail (12), and the two edge ribs (30) are substantially the height of the space between the lower portion of the rail (12), and the intermediate flanges (18).

In order to make a still more secure fit, a fastening screw (34) may be inserted from the under side of the rail (12), pressing planar portion (32) upwardly against the interior flanges (18). In order to permit making a snug fit of the insertion portion (24) into the rail (12), the attachment portions (26) are formed with generally rectangular indented recesses (36) on each side. The recesses (36) are spaced downwardly from the angled bend (38) separating the insertion portion (24) from the attachment portion (26).

Figure 2:
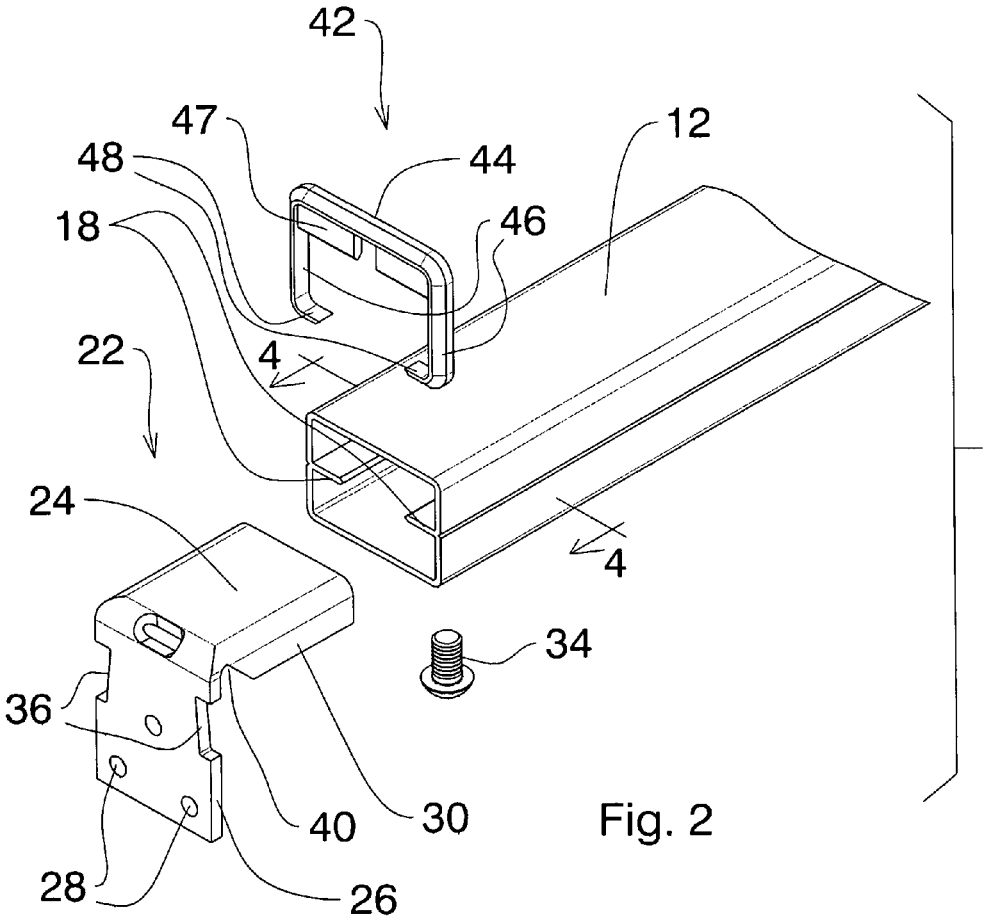
FIG. 2 is an exploded perspective showing the interconnection between the end of a fence rail and the mounting bracket.

In addition, in order to permit some degree of flexibility in the angling of the rail (12), relative to the post (10), the edge ribs (30) are formed with diagonal cut-outs (40) (Fig 2).

In this way it becomes possible for the intermediate portion (24) to be bent at a non right angle relative to the attachment portion (26), if that becomes necessary to accommodate variations in terrain or design of the fence.

Figure 5:
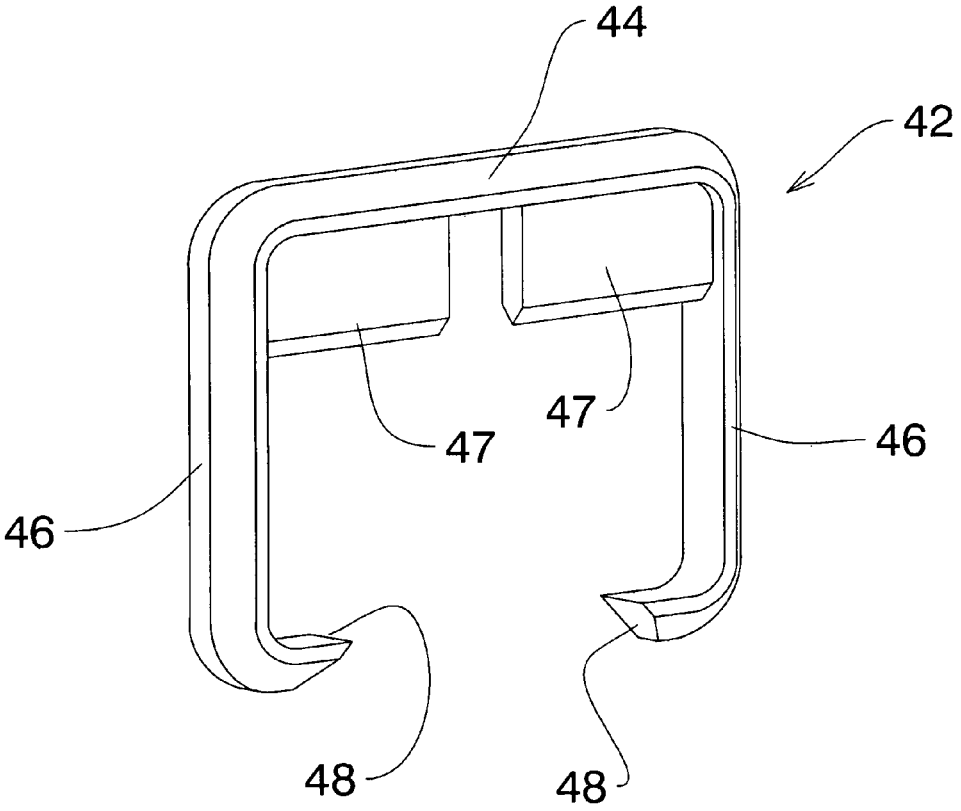
FIG. 5 is a perspective illustration of a trim clip.

In order to make a snug fit around each end of each hollow tube (12) where it abuts against the post (10), end finishing clips (42) also referred to as bezels are provided (FIG. 2 and FIG. 5). These clips may be made of any suitable thermo plastic material, or metal such as aluminum, and define a transverse portion (44) and side arms (46) and in-turned hooks (48). Along the extent of the transverse portion (44), there are two downwardly dependent flange portions (47) separated in the middle between them by a recess, to permit flexibility.

The rails (12) are typically formed with a series of baluster holes (49), space intervals there along (Fig 3) but can also be formed with holes as pilot holed to secure baluster connectors commonly found in the marketplace.

These holes will typically be pre-drilled, and permit the insertion of balusters (14). In order to retain the baluster (14) within the rails, the interior flanges (18) within the rails (12) are formed with generally V-shaped sharpened edges (20), which are intended to make a frictional fit on the opposite sides of the baluster (14).

Figure 6:
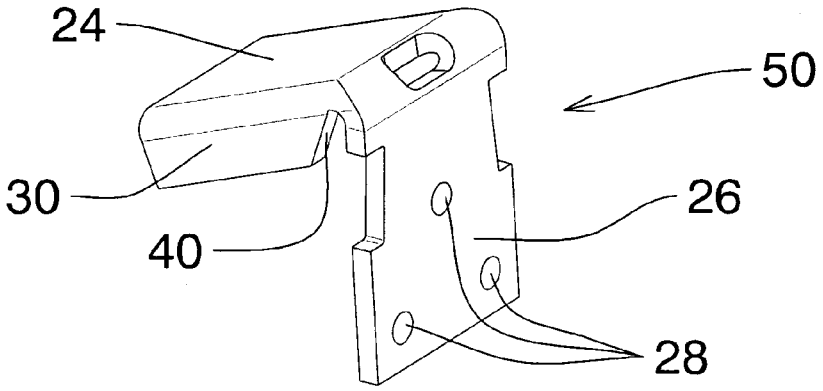
FIGS. 6 and 7 are perspectives of alternate angled mounting brackets.
Figure 7:
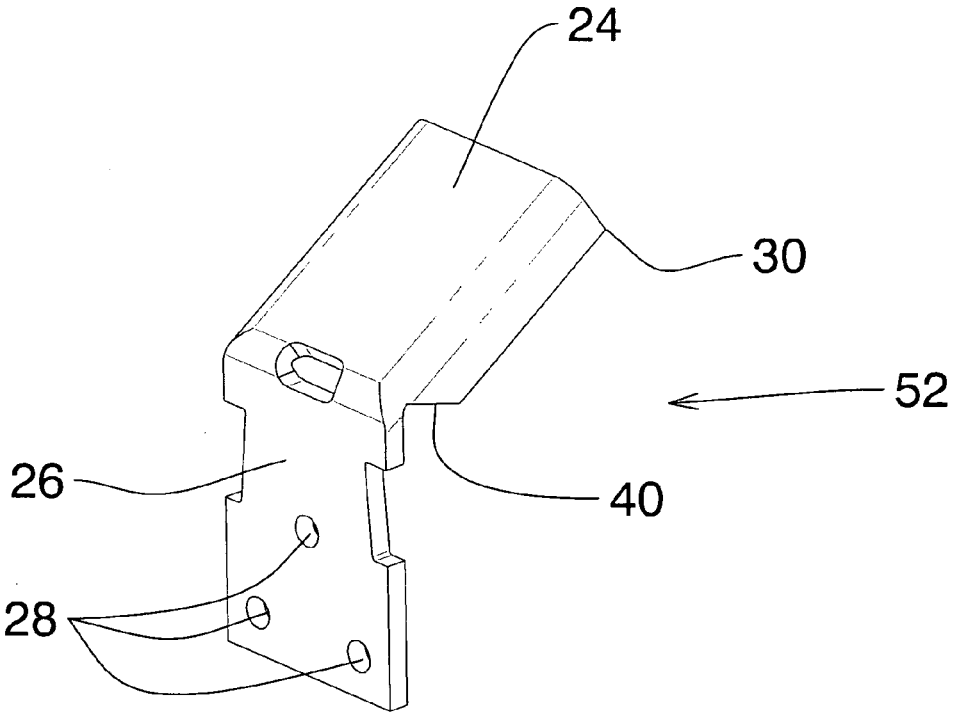

A modified embodiment of the mounting bracket is shown in FIGS. 6 and 7, referenced as (50) and (52).

It will be appreciated that when installing the railings on stairs, brackets (50 and 52) will be provided which are pre-bent, bracket (50) being at an acute angle and bracket (52) being bent at an obtuse angle. The precise angles of bend are not material. They can be adjusted within limits by hand tools, on site. The use of such angled brackets will enable the mounting rail to be mounted in an angular relation relative to the vertical posts along side the stairs (not shown).

Figure 8:
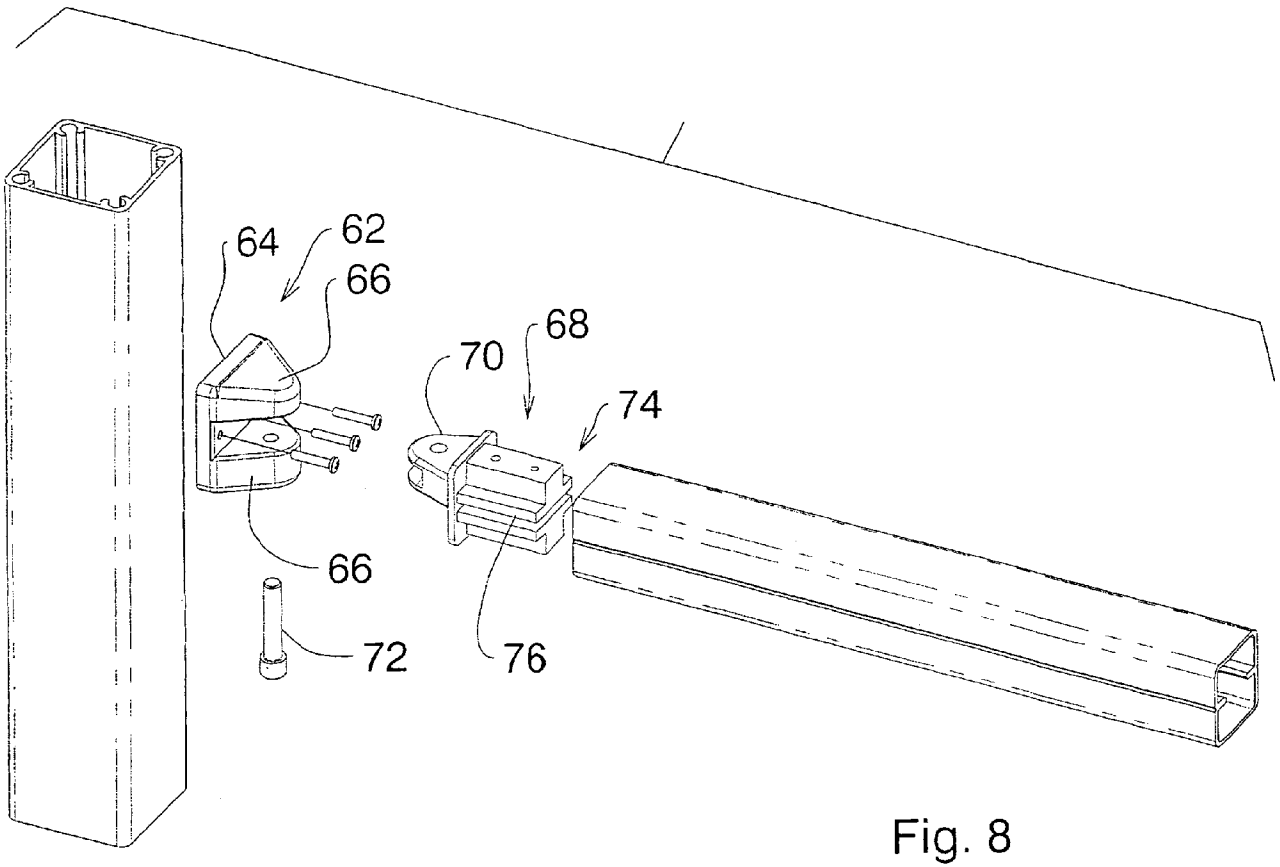
FIG. 8 is an exploded illustration of an alternate hinged mounting bracket and rail; and, FIG. 9 is an exploded perspective of another rail, and hinged mounting bracket.

It will also be appreciated that in some cases the railings may be required to be erected in a more complex configuration, where the fence defines angled corners which are non right angular. In these cases it is not practical to provide fence posts with non right angular sides. Therefore, in order to accommodate angular configuration of the fence, while using fence posts with regular rectangular faces, a hinged bracket is provided (FIG. 8)

In this case, the bracket comprises a first fence post attachment portion (62), having a fence flange (64) and two hinge arms (66) provided with a hinge hole.

The bracket (60) further comprises a swingable hinge body (68), defining a hinge tongue (70) extending from the body to be received in the hinge arms (66).

A hinge pin (72) extends through holes in the hinge arms and hinge tongue.

The hinge body further defines a rail insert, of a shape corresponding to the rail defining a central body (74), and side grooves (76, 76), fitting snugly within the ends of the fence rails.

The body (74) will substantially fill the entire interior of the rail, and the side grooves will accommodate the interior flanges.

Figure 9:
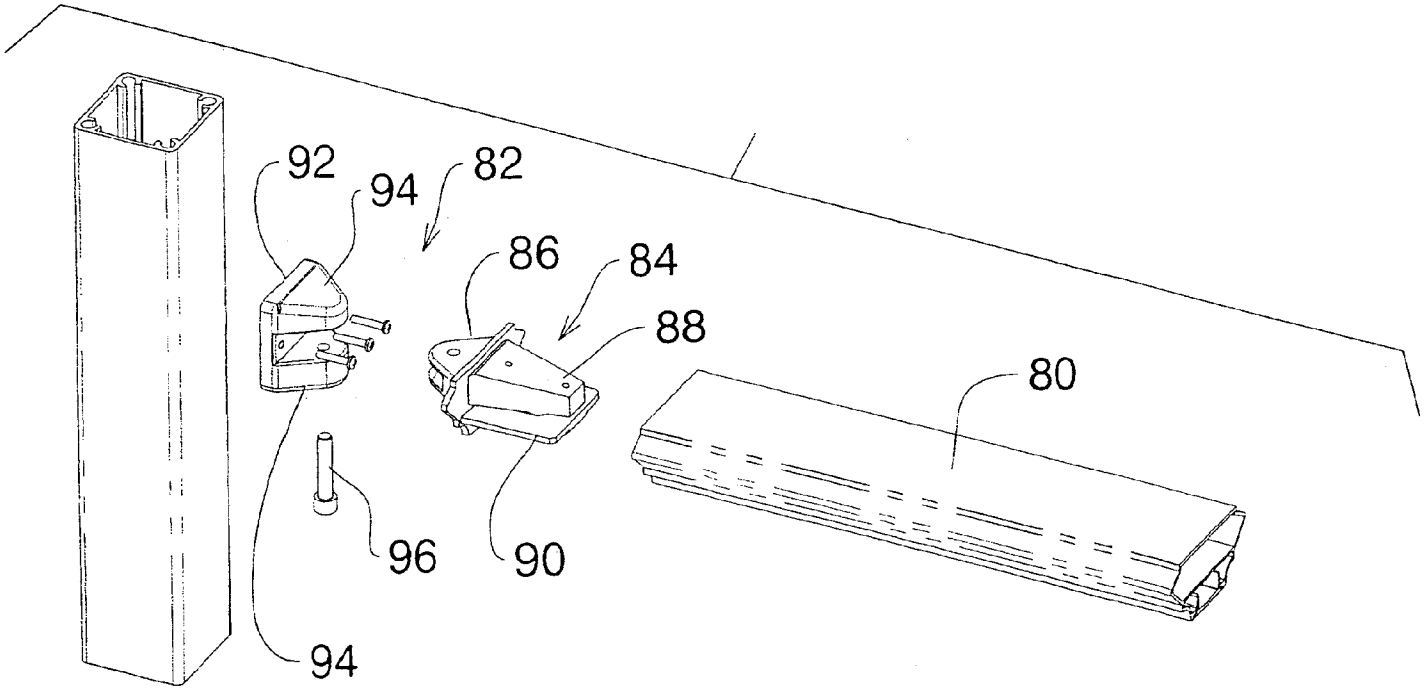

In accordance with the further embodiment shown in FIGS. 9, a further alternate form of hinged bracket is provided, for the rail (80).

In this case, the rail is shaped differently from the previous rail and is intended to provide a rail more suitable, for example, for hand hold. In this case the bracket (82) has a swingable hinge body (84), defining a hinge arm (86).

The hinge body (84) defines an interior having a generally rectangular upper portion (88) with a generally tapering shape wedge shape and an elongated lower member. Side plates (90) extend outwardly from the body. In this way, the body and the side arms fit snugly within the interior of the profile of the rail. A mounting plate (92) has two tongues (94) for receiving arm (86) held by pin (98)

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fence system comprising;

upright posts;

transverse fence rails, formed of hollow rectangular tubular construction defining side walls and top and bottom walls extending between the posts;

internal flanges formed in a common plane on respective side walls extending lengthwise within the hollow rails for resisting bending forces and defining a space there between;

a plurality of angular attachment brackets, each said bracket defining a rail insertion portion and a post attachment portion, and wherein the rail insertion portions are adapted to make a sliding frictional fit within the interior of said hollow tubular rails;

a plurality of fastening holes in said post attachment portions, whereby the same may be secured to a post; and an end finishing clip having a horizontal transverse cross portion and upright side portions, and having inturned hook portions at the ends of said upright side portions adapted to be snap fitted around a fence rail, adjacent the junction with a said fence post;

a plurality of baluster holes in the hollow rails; and a plurality of upright intermediate balusters passing through respective baluster holes in said hollows rails and secured within said hollow rails by making a friction fit between the interior flanges.

2. The fence system as claimed in claim 1 including a fastening member adapted to be inserted from the underside of a fence rail, engaging said insertion portion of said bracket.

3. The fence system as claimed in claim 2 whereby the insertion portion of the bracket defines edge ribs and a planar portion, said edge ribs being normal to said planar portion.

4. The fence system as claimed in claim 3 whereby the insertion portion and the attachment portion of the bracket meet one another at an angled bend, and including rectangular recesses formed in said attachment portion adjacent to said bend.

5. The fence system as claimed in claim 4 wherein said edge ribs define diagonal ends adjacent said bend.

6. The fence system as claimed in claim 1 wherein said internal flanges define inwardly directed sharpened V-shaped formations, spaced apart and gripping opposite sides of each baluster.

* * * * *